US005319616A

United States Patent [19]

Jolidon

[11] Patent Number: 5,319,616

[45] Date of Patent: Jun. 7, 1994

[54] PIECE OF JEWELRY, MORE PARTICULARY A TIME PIECE WITH CHANGEABLE APPEARANCE

[75] Inventor: Hugues Jolidon, Courfaivre, Switzerland

[73] Assignee: Be & Joy SA, Switzerland

[21] Appl. No.: 598,695

[22] PCT Filed: Jul. 20, 1990

[86] PCT No.: PCT/CH90/00177

§ 371 Date: Oct. 30, 1990

§ 102(e) Date: Oct. 30, 1990

[87] PCT Pub. No.: WO91/02299

PCT Pub. Date: Feb. 21, 1991

[30] Foreign Application Priority Data

Aug. 7, 1989 [CH] Switzerland ..... 02899/89

[51] Int. Cl.[5] ..... G04B 37/00

[52] U.S. Cl. ..... 368/282; 368/281; 368/276

[58] Field of Search ..... 368/281, 282, 276–280, 368/294–296

[56] References Cited

U.S. PATENT DOCUMENTS 3,585,794 6/1971 Klingenberg ..... 368/281
4,757,485 7/1988 Man ..... 368/281

*Primary Examiner*—Bernard Roskoski
*Attorney, Agent, or Firm*—Ostrolenk, Faber, Gerb & Soffen

[57] ABSTRACT

Annular support 19, provided on its upper side with circular beads 5 and 6, removably supports fitting 20. The latter is formed of a profiled ring 21, of rigid ring 22, and of the piece of fabric 23 which is stretched onto ring 22. The rim of container 24 secures fitting 20 on support 19.

19 Claims, 4 Drawing Sheets

FIG. 3
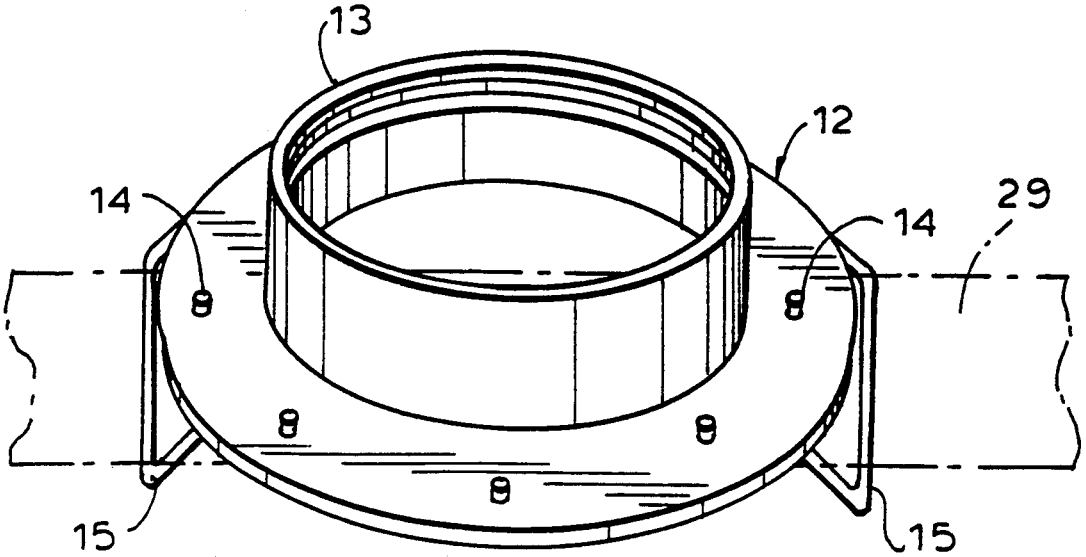
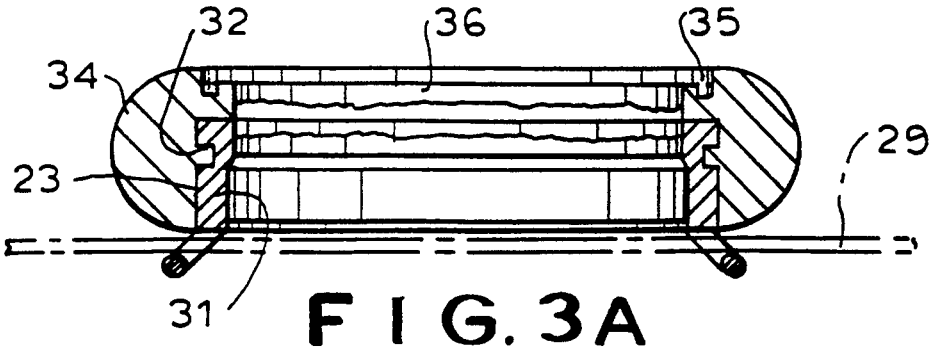
FIG. 3A
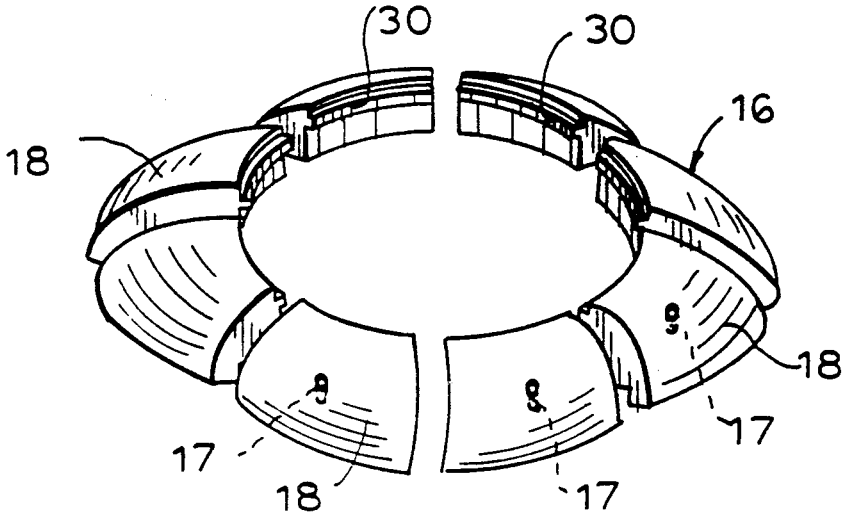
FIG. 4

PIECE OF JEWELRY, MORE PARTICULARY A TIME PIECE WITH CHANGEABLE APPEARANCE

BACKGROUND OF THE INVENTION

Timepieces and, more generally, pieces of jewelry of various appearances are today found in the market, but they do not allow any subsequent modification of their appearance by the user. In other words, once a decision to buy a determined type of wristwatch is made, the user will always be "tied" by this decision. If it is desired to wear a piece displaying a truly different appearance, e.g. because it is more adapted to the taste of the moment, to fashion, to the style of dress, or for any other reason such as the search for new combinations of the appearance using one's own creativity, the only resort will be a new purchase which in turn will sooner or later be subject to the same problem. To this day, this kind of problem is not resolved in a satisfactory manner.

Timepieces comprising a movement which is accomodated in a container-type enclosure and a annular member to which the container is removably fixed by pressure engagement are already known. However for reasons of space requirement and aesthetics, the annular member receiving the container generally fulfills a decorative function simultaneously with a supporting function.

In the case of wristwatches, the annular supporting member of the container is provided with connecting means for the bracelet. These means are relatively space-consuming and, above all, they have a nonsymmetrical shape, so that it is difficult to conceive a set of pieces having a plurality of different supports and a single container, and thus to provide a practical and adaptable assembly.

On the other hand, assemblies of elements are known which comprise a wristwatch casing, a set of exchangeable decorative pieces, and/or a set of bracelet elements, such that the appearance of the watch can be modified at will.

However, in these known assemblies, the heterogeneity of the components remains visible, such that the pursued aim, namely to obtain a modifiable aesthetic which still retains an unitary value, is not attained.

SUMMARY OF THE INVENTION

The objects of the present invention are on one hand, to bridge this gap and on the other hand, to enable the user to vary almost indefinitely the appearance of the piece of jewelry or in particular, of the timepiece, with respect to both its shape and its colors and without any tools.

In order to attain these objects, a first alternative embodiment of the piece of jewelry, in particular the timepiece, of the invention includes a fixed central element accommodated in a container. The container is removably fixed by pressure engagement to an annular member, wherein the annular member is a support having an external side. Rigid retaining elements are provided on the external side of the support and a removable decorative fitting is disposed on the support and has a side which cooperates with the retaining elements of the support. The decorative fitting is secured on the support by the container to conceal the external side of the support. In and a second alternative embodiment the piece of jewelry comprises a central element removably fixed in a support, rigid retaining elements provided on an external side of the support, a removable decorative fitting formed of a plurality of rigid elements disposed side by side adjoiningly located on the support, and retaining elements disposed on the plurality of rigid elements for engaging the retaining elements of the support to secure the decorative fitting on the support, with the decorative fitting concealing the external side of the support.

These characteristics may take different and multiple shapes, as will appear hereinafter in the description of several embodiments. However referring primarily to the first embodiment examples of the object of the invention are illustrated in the attached drawing.

BRIEF DESCRIPTION OF THE DRAWINGS

FIG. 3 is a perspective view of a support pertaining to a second embodiment;

FIG. 3A is a sectional view of a support and a fitting according to a third embodiment;

FIG. 4 is a perspective view of a fitting formed by a set of elements and pertaining to the embodiment of FIG. 3;

DESCRIPTION OF THE PREFERRED EMBODIMENTS

Figure 1:
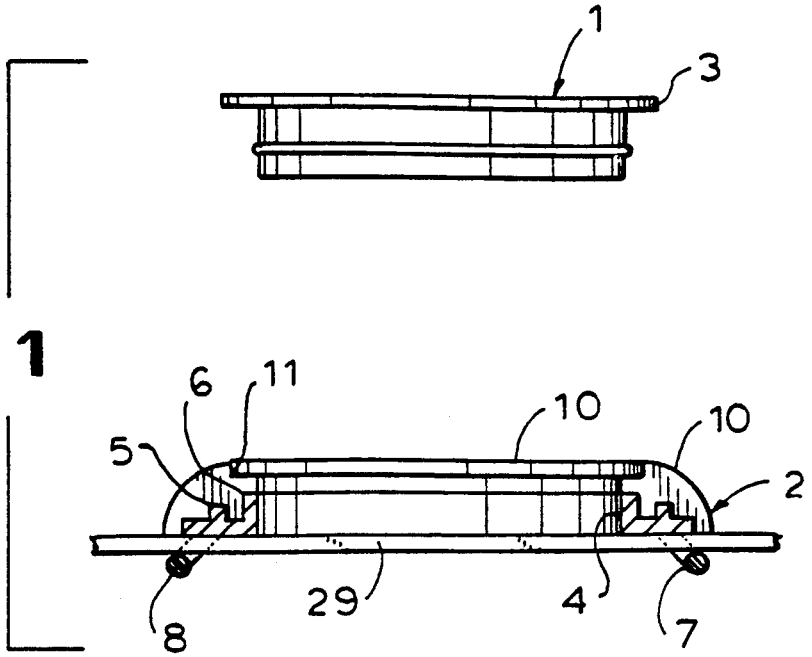
FIG. 1 is an enlarged axial cross-sectional view illustrating a first embodiment of a timepiece.

In the assembly shown in FIG. 1, container 1 is above its normal position of engagement in annular support 2. Container 1 consists, according to the traditional construction, of a watch movement which is covered by a dial and accommodated in a simplified casing having a cylindrical form, and closed by a bezel carrying a glass. The bezel is provided with an outer rim 3, the purpose of which will be explained below. Generally, it is understood that the term annular is not limited in the present description and the claims to a circular shape.

Support 2 is a piece of metal or plastic material and is provided with a central, cylindrical opening 4 which is adjusted to the diameter of container 1. The upper side of support 2 comprises a holding structure which in the assembly described here is formed of two beads 5 and 6 that are separated by a groove. This structure is preferably circular and coaxial with respect to opening 4. A flat shoulder extends on the periphery of the piece 2, the shoulder limiting the outer bead 5 towards the bottom on its entire circumference.

On the underside of the support, two square or rectangular loops 7 and 8 are fixed, e.g. by welding, which form lugs for the passage of a flexible bracelet 29 made of leather, textile material, plastic or of another structure. Instead of lugs 7 and 8, other attaching means could be imagined in order to allow the connection of other types of bracelets, in particular metallic ones.

Figure 2:
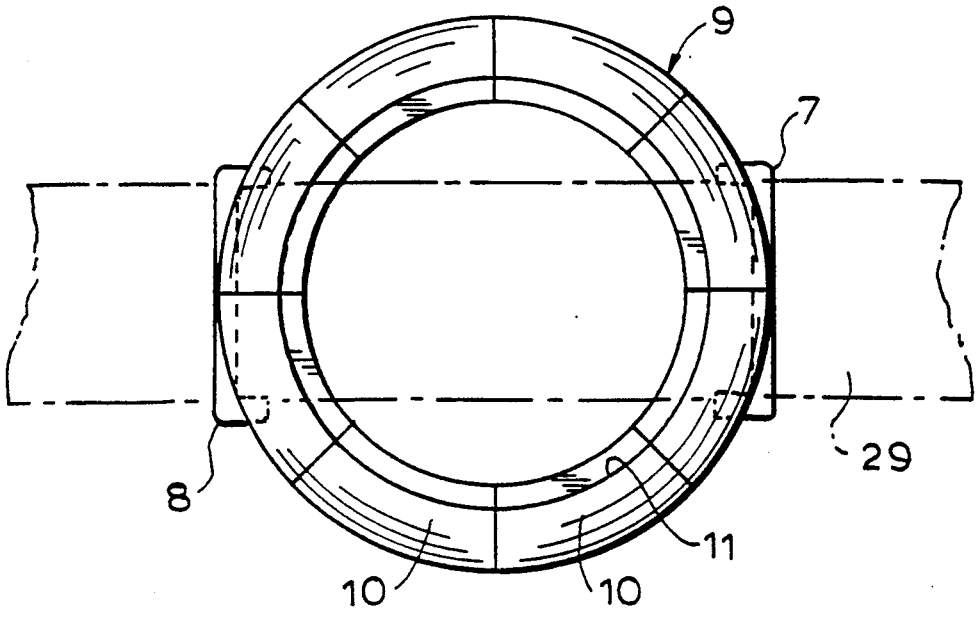
FIG. 2 is a plan view from above of the timepiece of FIG. 1 without the container.

The rigid structure on the upper side of support 2 and the rim 3 of container 1 constitute retaining means which cooperate in order to secure a decorative fitting 9 (FIG. 2) to support 2 when rigid pressure engagement of the container 1 in opening 4 is completed. Fitting 9 covers and conceals support 2 and is exchangeable, such that the described watch can be marketed with a set of different fittings allowing variation of the appearance of the watch at will. In the embodiment described here, the fitting is formed by a set of eight elements having the shape of crown sectors which are referenced by 10.

Each element 10 is provided with an underside having a structure which is complementary to that of beaded structure 5,6, in such a manner that it interlocks therewith freely but without a clearance. Moreover, the elements 10 comprise on their upper and inner edge a notch 11 which is adapted to rim 3. The elements 10 are thus immobilized by container 1 without their securing means being visible.

From the point of view of aesthetic of the described watch, the elements 10 allow countless variations and effects impossible to obtain otherwise. Even in the case where the set of elements 10 forms a fitting 9 having a regular contour, e.g. a circular one, as shown here, or a rectangular oval, etc., the neighboring elements can be made of different metals or materials, or their reliefs can differ. It is also possible to provide different surface finishes for neighboring elements or in a determined sequence, such as polished or brushed surfaces, etc.

FIGS. 3 and 3A show another embodiment with respect to the retaining means. Support 12 (FIG. 3) is provided with a central opening which is limited by a projecting tubular portion 13. Tubular portion 13 rises from a flat shoulder having equidistant plugs 14 mounted therein. The means for connecting support 12 to a bracelet are formed here by four lug elements 15 which are joined below the support and are each fixed to a point of the outer periphery of the support. In FIG. 3A, support 31 is provided with retaining elements 32 on its lateral outer surface 33. The inside surface of decorative fitting 34 with surface 33 in such a manner that the fitting is radially secured. The upper portion of fitting 34 is provided with a groove 35 which cooperates with container 36 in order to secure the fitting axially.

Decorative fitting 16 (FIG. 4), which corresponds to support 12, is composed of elements 18 resembling the elements 10, the underside of which however, are flat or provided with an outer rim, and each comprises a blind hole 17 which engages with plugs 14 under friction. In this case, as well, the rim of the container engages in a notch 30 provided in the portion of the element which covers the top of cylinder 13.

FIG. 4 illustrates a possible embodiment of the fitting 16. The elements 18 may be made of plastic material so that the friction engagement with plugs 14 is resistant without offering any difficulties when putting the elements in place. The plugs and the corresponding holes might also have the shape of mushrooms or of dovetails which could be arranged on the outer lateral surface of the cylinder 13. Other arrangements could be imagined as well. It appears in FIG. 4 that the elements 18 give the fitting a convex contour which can deviate from a circle. However, this contour might also be toothed, in the form of flower petals, etc. Here again, there is a great number of different aspects which can be imagined. Using some sets of different elements, the variety of possibilities available to the user is almost unlimited.

The retaining structure characterizing the support is not necessarily intended to receive a fitting made of different elements which are placed next to each other on the support.

Figure 5:
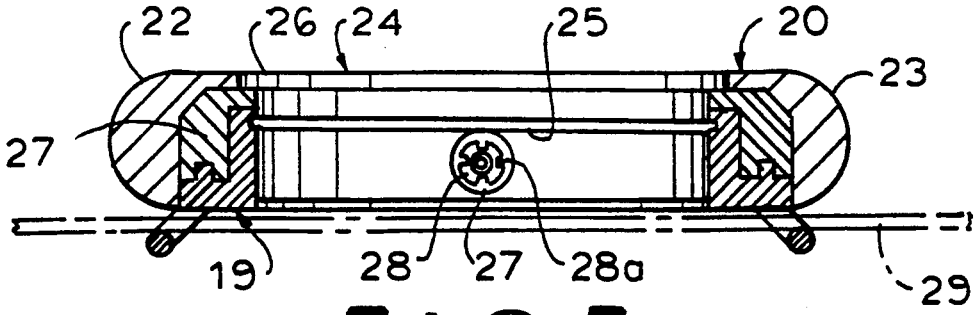
FIG. 5 is a coaxial sectional view of a support and a fitting pertaining to a fourth embodiment.

Thus, FIG. 5 shows an embodiment wherein a support 19, which might have the same configuration as support 2, supports a decorative fitting 20 the securing means of which are invisible and which conceals the support, and which is interchangeable. The fitting 20 is formed of an assembly of annular components which are assembled in a single block. One these components is a rigid ring 21 which on its underside shows a configuration which is adapted to the retaining elements of the support, and on the upper side is adapted to secure the remaining components by pressure. The latter comprise a rigid ring 22 having a rounded external surface on which a piece of fabric 23 is stretched the edges of which may be sewn or glued together on the back of ring 22. The underside of ring 22 has a concave shape by which the piece of fabric 23 is stretched in such a manner that engagement of the unit 22,23 on ring 21 ensures tension of the fabric.

Figure 5A:
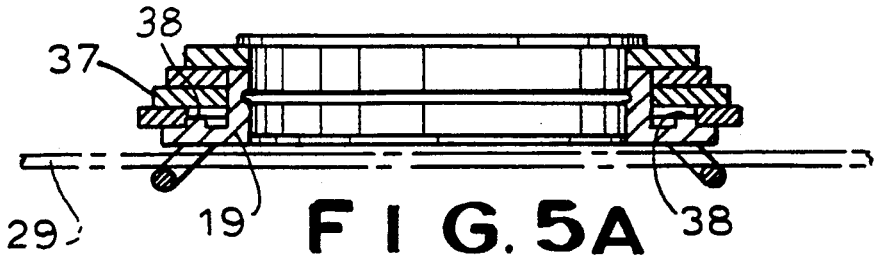
FIG. 5A is a coaxial sectional view of a support and a fitting pertaining to a fifth embodiment.

In FIG. 5A, the upper surface 37 and the lateral surface 38 of support 19 cooperate with a fitting which is composed of superposed coaxial annular elements. Moreover, in an embodiment which is not shown, these elements can each time be encased into each other.

This example demonstrates the multiple possible configurations of the fitting allowed by the invention. Said fitting could also be a hollow piece made of a transparent material and containing a liquid mass or a gas, or even a metallic piece, e.g. in the form of a toroid. The cross-section of this toroid could deviate from a circle, the lower and inner sides having such a configuration as to adapt to the retaining elements.

Figure 6:
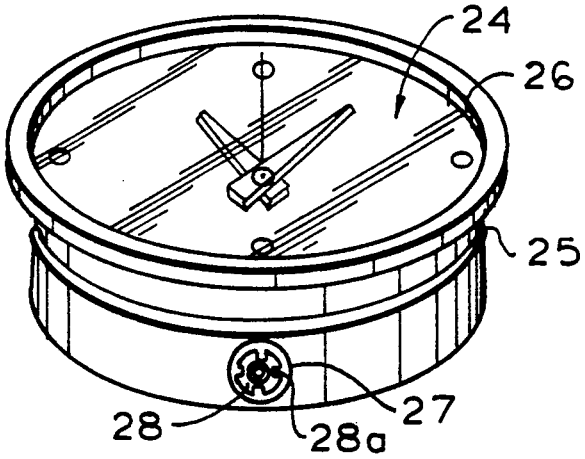
FIG. 6 is a perspective view of a container.

The container appears again in FIGS. 5 and 6. It is different from container 1 in that a peripheral blocking bead 25 mounted in its lateral cylindrical surface is provided immediately under the rim 26, as opposed to FIG. 1 where it is near the lower edge. This difference is conditioned by the solution provided to the problem of the crown. Generally, the presence of a crown allowing to set the hour and, in some cases, to adjust the calendar, is necessary. One possibility therefor is to provide, preferably in all the elements of the decorative fitting, a housing in its inner surface. The crown of the container, which is normally projecting from the cylindrical surface of this component, is engaged in the housing of the fitting in such a manner that the container and the element of the fitting provided with the housing are put into place simultaneously.

However, a plate 28 could as well be provided in a milling 27 arranged in the lateral surface of the container, plate 28 being set onto a tubular segment the portion of which crimped inwardly of the container wall and which is driven onto the command shaft. As appears in FIGS. 5 and 6, plate 28 can be provided with millings **28*a*** allowing its operation by means of tweezers.

Figure 7:
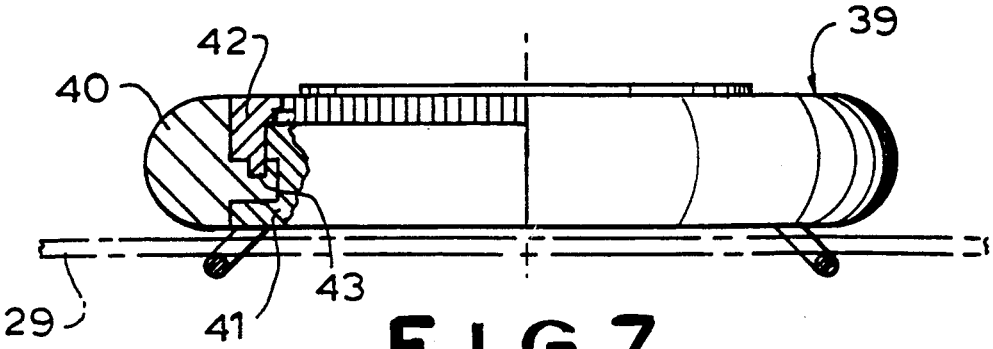
FIG. 7 is a half-section according to line VII—VII in FIG. 8, of a second variant of the object of the invention.
Figure 8:
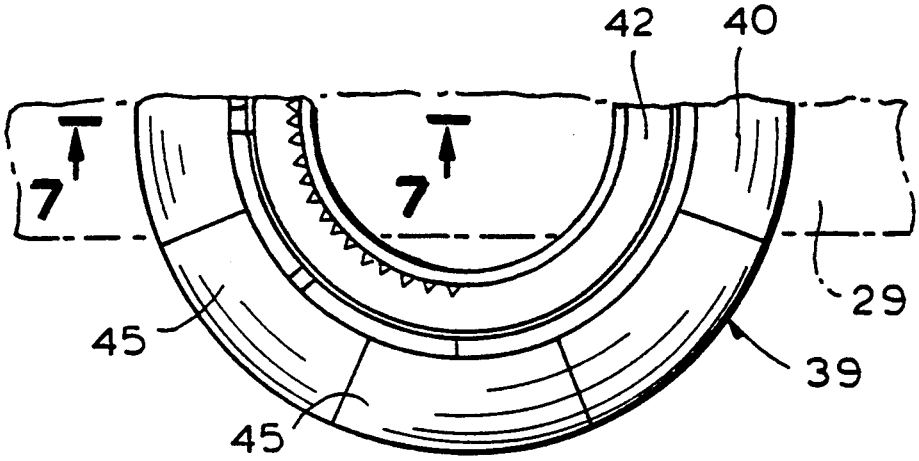
FIG. 8 is a view from above of this second variant.

In a second variant 39, illustrated in FIGS. 7 to 11, support 41 of the decorative fitting 40 simultaneously serves as a casing middle or a "false middle". The outside of the middle is provided with retaining elements 43 cooperating with the inside of the fitting 40. Radial securing of the fitting is obtained due to a ring 42 fixed on the middle or false middle e.g. by means of the known method used in turning bezels for diving watches (FIG. 7 and 8).

Figure 9:
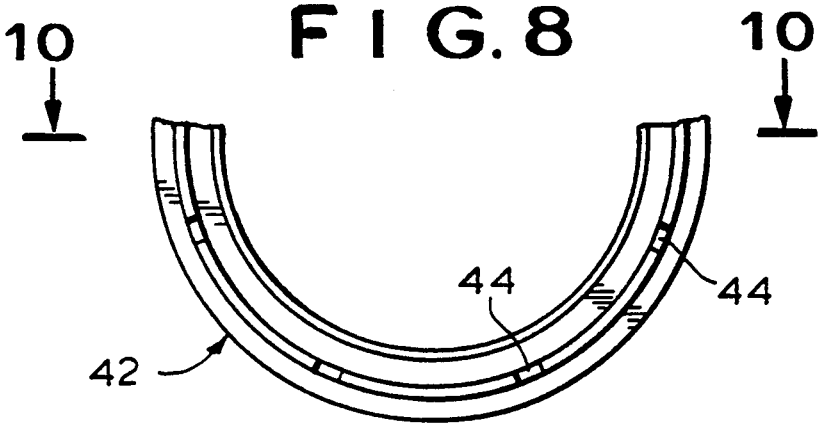
FIG. 9 is a view from below of the retaining ring.
Figure 10:
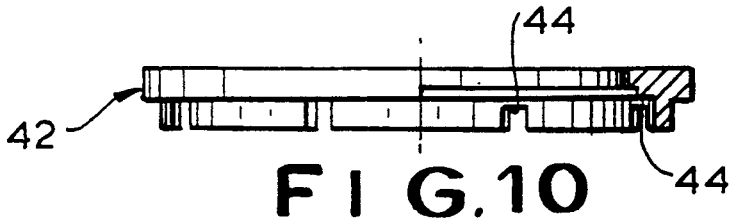
FIG. 10 is a half section of the retaining ring.

FIGS. 9 and 10 illustrate incisions 44 arranged under ring 42, allowing attachment and detachment of the decorative elements 45 which form the fitting 40 which may be identical, as their external form is concerned, to elements 10 or 18, for example.

Figure 11:
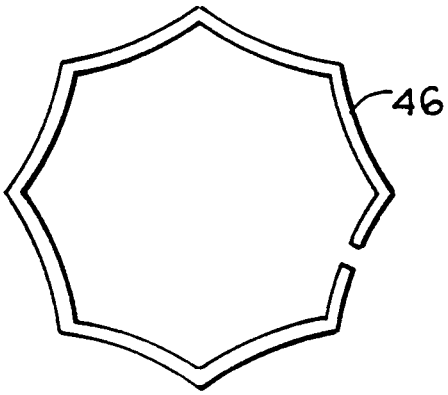
FIG. 11 is a resilient connecting element.

FIG. 11 represents an elastic member 46 for the fixation of ring 42 to the middle or false middle, i.e. to support 41.

It is self-evident that all the characteristics and specifications as to the means enabling the modifiable presentation of the piece of jewelry or the timepiece and described under the first alternative embodiment, can be taken up and applied identically or analogically to this second variant. Consequently, these characteristics and specifications are not described again.

Of course, if the object of the invention is a piece of jewelry, such as a pendant, earrings, etc., known and suitable attachments will be provided instead of bracelet lugs. It is clear that the movement is then replaced by a fixed central element of decoration.

Besides the fact that it can be presented under different aspects, the timepiece and, more generally, the piece of jewelry of the invention allows the user to apply his or her personal creative capacities, thanks to the multiple combinations which are made possible by said piece.

I claim:

1. A piece of jewelry comprising:

a fixed central element accommodated in a container;

an annular member to which said container is removably fixed by pressure engagement, wherein said annular member is a support having at least one external side;

rigid retaining elements provided on said at least one external side; and a removable decorative fitting disposed on said support and having at least one side which cooperates with said retaining elements of said support, said decorative fitting being secured on said support by said container, said decorative member concealing said at least one external side of said support.

2. The piece of jewelry according to claim 1, wherein said container comprises a lateral surface engageable with in an opening of said support with pressure, and an upper rim for retaining said fitting.

3. The piece of jewelry according to claim 1, wherein said fitting is formed of a set of rigid elements having the shape of crown sectors, which are disposed side by side adjoiningly and are engaged on said retaining elements.

4. The piece of jewelry according to claim 3, wherein said decorative fitting forms an annular block and comprises on its circumference several connecting areas, one of which conforms with the rim of said container in such a manner as to be blocked by said rim, and another or the others of which conform with retaining elements of said support.

5. The piece of jewelry according to claim 4, wherein said fitting is a set of several annular components which are assembled in a block one of said components being a rigid ring the profile of whose base is adapted to the retaining elements of said support, and one or several other components being made of non-rigid materials.

6. The piece of jewelry according to claim 5, wherein said fitting comprises a piece of fabric stretched on a rigid annular component fixed to said rigid ring.

7. The piece of jewelry according to claim 1, wherein said fitting is formed of an assembly of several superposed annular components, the uppermost component having a connecting area conforming with the rim of said container in such a manner as to be blocked by said rim, and the other components having each at least one surface which is adapted to the retaining elements of said support.

8. The piece of jewelry according to claim 1, wherein said fitting is formed of an assembly of several annular components which are encased within each other, the top component having a connecting area conforming with the rim of said container in such a manner as to be blocked by said rim, and the component at the bottom having a surface which is adapted to the retaining elements of said support.

9. The piece of jewelry according to claim 5, wherein said fitting comprises a component which is formed of a liquid mass or a gas or of metal occupying an annular space which is limited by another at least partially transparent component.

10. The piece of jewelry according to claim 1, having the configuration of a wristwatch, and said support comprising connecting means for a bracelet which is covered by said fitting.

11. A piece of jewelry comprising:

a central element;

a support having at least one external side, said central element being removably fixed in said support;

rigid retaining elements provided on said at least one external side of said support;

a removable decorative fitting having at least one side disposed on said support, said decorative fitting being formed of a plurality of rigid elements which are disposed side by side adjoiningly, wherein said plurality of rigid elements have the shape of crown sectors; and retaining means disposed on said plurality of rigid elements for engaging said retaining elements of said support to secure with said central element said decorative fitting on said support, said decorative fitting concealing said at least one external side of said support.

12. The piece of jewelry according to claim 11, wherein said fitting is formed of an assembly of several annular components, each having at least one side which cooperates with the retaining elements of said support to secure the annular components on said support.

13. The piece of jewelry according to claim 11, having the configuration of a wristwatch, and said support comprising connecting means for a bracket which is covered by said fitting.

14. The piece of jewelry of claim 11, wherein said central element is a decorative piece.

15. The piece of jewelry of claim 11, constituting a timepiece, said central element being a watch movement.

16. The piece of jewelry of claim 11, wherein said support is a casing middle.

17. The piece of jewelry of claim 11, wherein said support is a false middle.

18. The piece of jewelry of claim 16, wherein said retaining means comprises a ring disposed on said casing middle.

19. The piece of jewelry of claim 17, wherein said retaining means comprises a ring disposed on said false middle.

* * * * *